US006626127B2

(12) United States Patent
Eichinger et al.

(10) Patent No.: US 6,626,127 B2
(45) Date of Patent: Sep. 30, 2003

(54) APPLICATION DEVICE

(75) Inventors: Kurt Eichinger, Wilhelmsburg (AT); Lothar Pfalzer, Ravensburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/070,269

(22) PCT Filed: Jun. 29, 2001

(86) PCT No.: PCT/DE01/02426

§ 371 (c)(1),
(2), (4) Date: Mar. 1, 2002

(87) PCT Pub. No.: WO02/04744

PCT Pub. Date: Jan. 17, 2002

(65) Prior Publication Data

US 2002/0162503 A1 Nov. 7, 2002

(30) Foreign Application Priority Data

Jul. 4, 2000 (DE) ..... 100 32 500

(51) Int. Cl.[7] ..... B05C 3/02
(52) U.S. Cl. ..... 118/40; 118/419
(58) Field of Search ..... 118/405, 419, 118/414, 424, 404; 427/209, 211, 434.2, 434.4

(56) References Cited

U.S. PATENT DOCUMENTS

| | | | | |
|---|---|---|---|---|
| 4,340,623 A | 7/1982 | Justus | ..... | 427/361 |
| 4,358,484 A | 11/1982 | Alheid | ..... | 427/296 |
| 4,407,224 A | 10/1983 | Alheid | ..... | 118/405 |

FOREIGN PATENT DOCUMENTS

| | | | | |
|---|---|---|---|---|
| DE | 295 13 970 U1 | 1/1996 | ..... | B05C/1/08 |
| DE | 296 10 446 U1 | 10/1996 | ..... | B05C/1/08 |

*Primary Examiner*—Brenda A. Lamb
(74) *Attorney, Agent, or Firm*—Taylor & Aust, P.C.

(57) ABSTRACT

The invention relates to a device for the application of a liquid medium onto at least one side of a moving material web, specifically a cardboard web, including at least one roll and at least one feed device for the coating medium, whereby during operation of the device a liquid sump forms between the roll and the web. Nozzle lips of a nozzle body of the feed device are configured so that the desired dimension of the open surface of the liquid sump and the depth of immersion of the nozzle lips into the liquid sump, and thereby the level of the liquid sump are adjustable. The nozzle lips are surrounded up to 80% of their total length by the liquid sump.

11 Claims, 2 Drawing Sheets

APPLICATION DEVICE

BACKGROUND OF THE INVENTION

1. Field of the Invention

The present invention relates to a device for the application of a liquid medium onto a moving material web, and, more particularly to the application of a liquid medium onto a moving cardboard web.

2. Description of the Related Art

The Voith publication p 2745, FIG. 1 describes a so-called size press. The size press includes two parallel rolls that form a nip through which the paper web travels. There is a liquid sump between the web and each of the two rolls, so that the web is impregnated simultaneously from both sides during operation. This device has the disadvantage that, with increasing web speed, the liquid in the sump is subject to very high turbulence, causing the liquid to splash into the surrounding area, for example onto device components and onto the web. Such splashing precludes a uniform application of liquid onto the web.

An attempt was made, with the device described in DE 29513970, to avoid splashing with the help of displacers or stabilizers. However, the device described in DE 29513970, has not proven completely satisfactory during operation.

Coating medium feed devices that dip into the sump are known from DE 29610446. A method and a device including a feed device, that dips into the sump, is also known from U.S. Pat. No. 4,358,484 and U.S. Pat. No. 4,407,224. In each case the feed device includes a main distributor tube that is equipped with delivery openings along its entire length. These delivery openings are connected with a flow channel for the formation of the sump. The flow channel is part of a nozzle body. The nozzle body includes parallel walls, extending across the entire width of the feed device Nozzle lips, that are located on these parallel walls, dip into the sump. The nozzle body is divided, in its center, by a wall into the aforementioned flow channel in order to supply the sump, and into another channel, which discharges the coating medium, of the sump, by way of vacuum, in order to create a reservoir. The arrangement thus described is a loop, in which coating medium is supplied from the reservoir to the sump, and it is again discharged.

It is the intent of these solutions to keep the depth of the sump as low as possible in order to avoid splashing and significant turbulence.

However, the design of these devices is relatively expensive, since there is a collection chamber at the discharge channel from which the medium must be pumped into the reservoir. Moreover, the entire device is permanently installed. In the event of a roll change the entire device must be dismantled, which is very labor and cost intensive.

SUMMARY OF THE INVENTION

The present invention provides an improved application device that includes ease of cleaning, ease of operation and ease of adaptation to specific application situations, at the same time largely avoiding splashing from the sump.

The inventor has recognized that, considering the current high operating and web speeds, the depth of the sump is not the decisive factor for a splash-free operation and a uniform coating application, but rather, that it is necessary to reduce the sump surface area.

Contrary to the teachings of the related art, it is even advantageous to let the sump level rise. This achieves a longer dwell time of the web in the sump, without causing saturating and/or breaking of the web, resulting in better penetration and uniformity of the coating application.

The desired dimension of the open sump surface can be adjusted by special nozzle lips, which are selected from a modular system and are matched precisely to the sump cross section, in shape and size. The nozzle lips are manufactured from a synthetic material. They can easily be manufactured in any desired shape and size and can easily be screwed or clipped onto the walls of the nozzle body.

During trials an immersion depth of up to approximately 80% of the height (or length) of the nozzle lips has proven to be the most effective, in avoiding splashing and unevenness in the application, and impregnation of the web.

It is especially advantageous if the entire delivery device is connected with a pivoting device. This arrangement allows the delivery device to be pivoted from the nip so that on the one hand, sufficient space remains to clean the roll, or rolls and on the other hand, the device need not be removed if one or both rolls need to be replaced. The pivoting arrangement is supported separately from the roll supports, in order to accommodate the last cited advantage.

Another, advantage of the device, in accordance with the present invention, is related to the structural shape of the nozzle body. The nozzle body is kinked or bent, starting from the nip, toward the outside. The shape of the nozzle body is chosen to compliment the shape of the roll. The lower section of the nozzle body is also matched to the form of the gusset, which is filled by the sump, existing between the roll and the supported, moving material web. It is also conceivable that the nozzle body is equipped with a joint, so that the desired deflection angle can be adjusted.

This aforementioned structural shape has an additional advantage in that the device is very compact. It distinguishes itself through a low construction height, which allows an operator a clear view of the roll, or rolls of the so-called size press or film press.

With regard to operational safety, the entire design offers a particularly effective nip protection for the operating personnel.

It must also mentioned that, for the purpose of a one-sided application, the applicator device is located and active only on one side. For the purpose of a two-sided application, application devices are located on both sides of the material web. Mention must also be made of the fact that, in place of the rolls, other types of support elements may be utilized, for example, moving flexible continuous belts.

It is effective if the nozzle, that is formed by the lips of the nozzle body, discharges the coating medium, that is supplied to the sump directly, downwardly, that is in the direction of the gusset tip. This ensures that the coating medium reaches the lowest point of the gusset and can therefore, be pressed reliably into the material web in the nip.

The medium discharging from the nozzle, the rolls or the support belts and also the moving material web have the same direction of travel. However, vortex formation can occur at especially high operating speeds, thereby possibly negatively influencing the coating application results. Another effective solution lies in the formation of the nozzle as a baffle nozzle. By locating a baffle-strip a small distance below the discharge opening, the arriving coating medium is redirected in a radial direction. The created cross flows reduce the undesirable vortex formation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
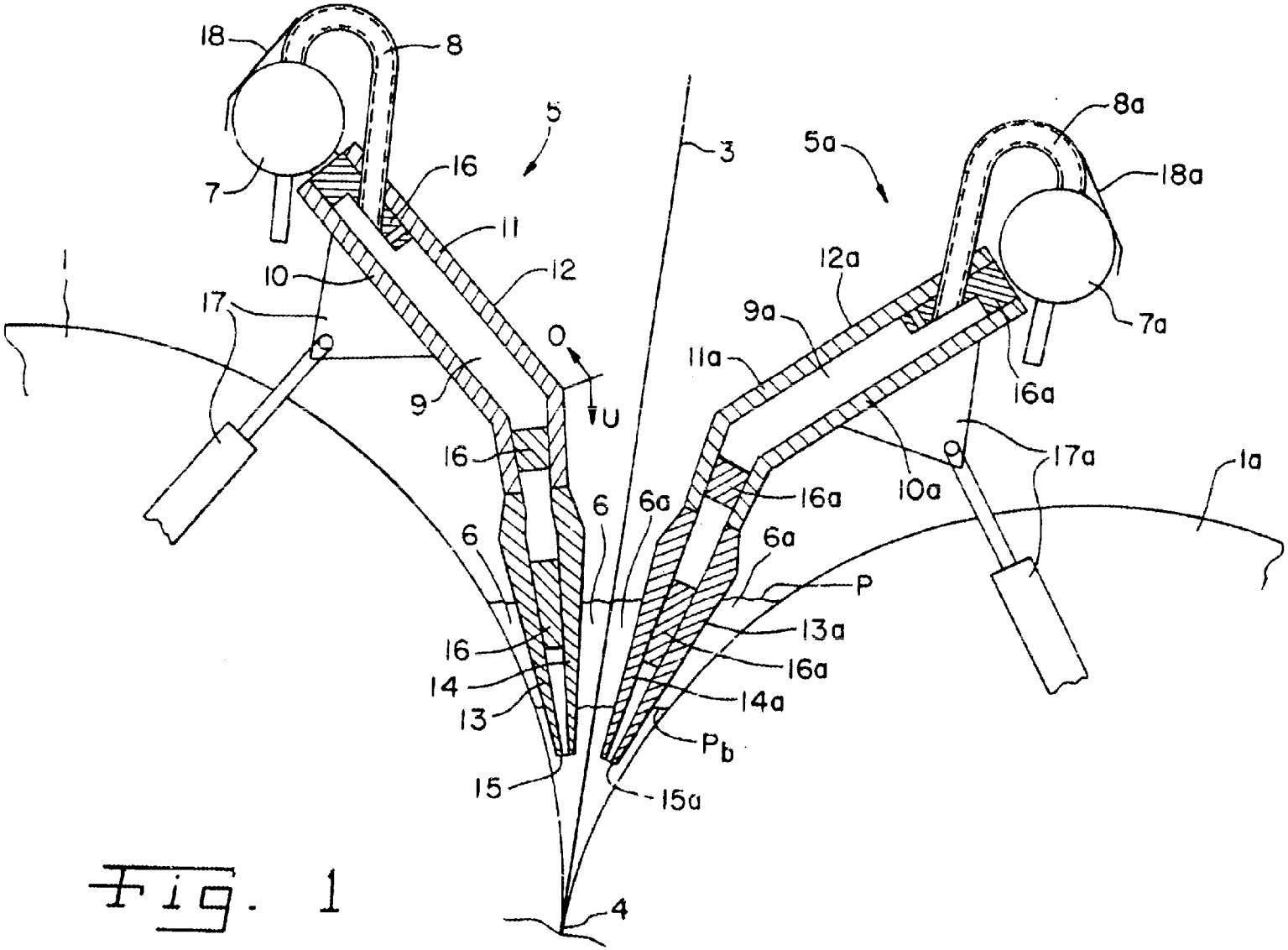
FIG. 1 is a cross-sectional view of the roll in a size press including the delivery system in accordance with the present invention, and a first embodiment of a nozzle.

Referring now to the drawings, and more particularly to FIG. 1, there is illustrated two rolls 1 and 1*a* which, together, form a press nip 4 through which a cardboard web 4 travels. Web 4 travels through nip 4 essentially from the top downward, whereby the angle of web entry into the nip is adjustable, however not illustrated here.

Coating medium 5 and 5*a* is located on each side of web 3 for a simultaneous two-sided application of a liquid medium, such as starch, onto web 3. Between the respective web sides and each of rolls 1 and 1*a* there is a so-called gusset Z and Za. During operation, sump 6, from which web 3 is coated, forms in gusset Z and Za. Based on the characteristics of web 3 the respective process is impregnating, sizing or coating.

Delivery system 5 and 5*a*, respectively, include main distributor pipes 7 and 7*a*. Main distributor pipes 7 and 7*a* are each machine-wide and receive the coating medium at the end faces thereof. A multitude of curved individual distributor pipes 8 and 8*a*, that are located uniformly along the length of main distributor pipes 7 and 7*a*, respectively, are discharged into from main distributor pipes 7 and 7*a*. Through pipes 8 and 8*a* precisely targeted volumes of coating medium are fed into metering slot 9 and 9*a*, respectively, so that a uniform supply is possible across the entire width, and thereby a uniform pressure distribution. Cover plates 18 and 18*a*, respectively, protect distributor pipes 8 and 8*a* from contamination. Additionally, this provides a largely closed, compact construction style of good design.

Metering slots 9 and 9*a* are located in the space between parallel walls 10 and 11, as well as 10*a* and 11*a*, respectively, which extend across the entire width of the device. Walls 10 and 11, form nozzle body 12 and walls 10*a* and 11*a* form nozzle body 12*a*. The lower section of nozzle bodies 12 and 12*a*, that is the part which dips into sump 6 and 6*a*, respectively, include specially formed nozzle lips 13 and 14, and 13*a* and 14*a*, effectively converging toward each other. Nozzle lips always leave nozzle openings 15 and 15*a* open between themselves at their lower open end, from which the coating medium gets down into the tip of gussets Z and Za, thereby creating, or maintaining sumps 6 and 6*a*.

Figure 2:
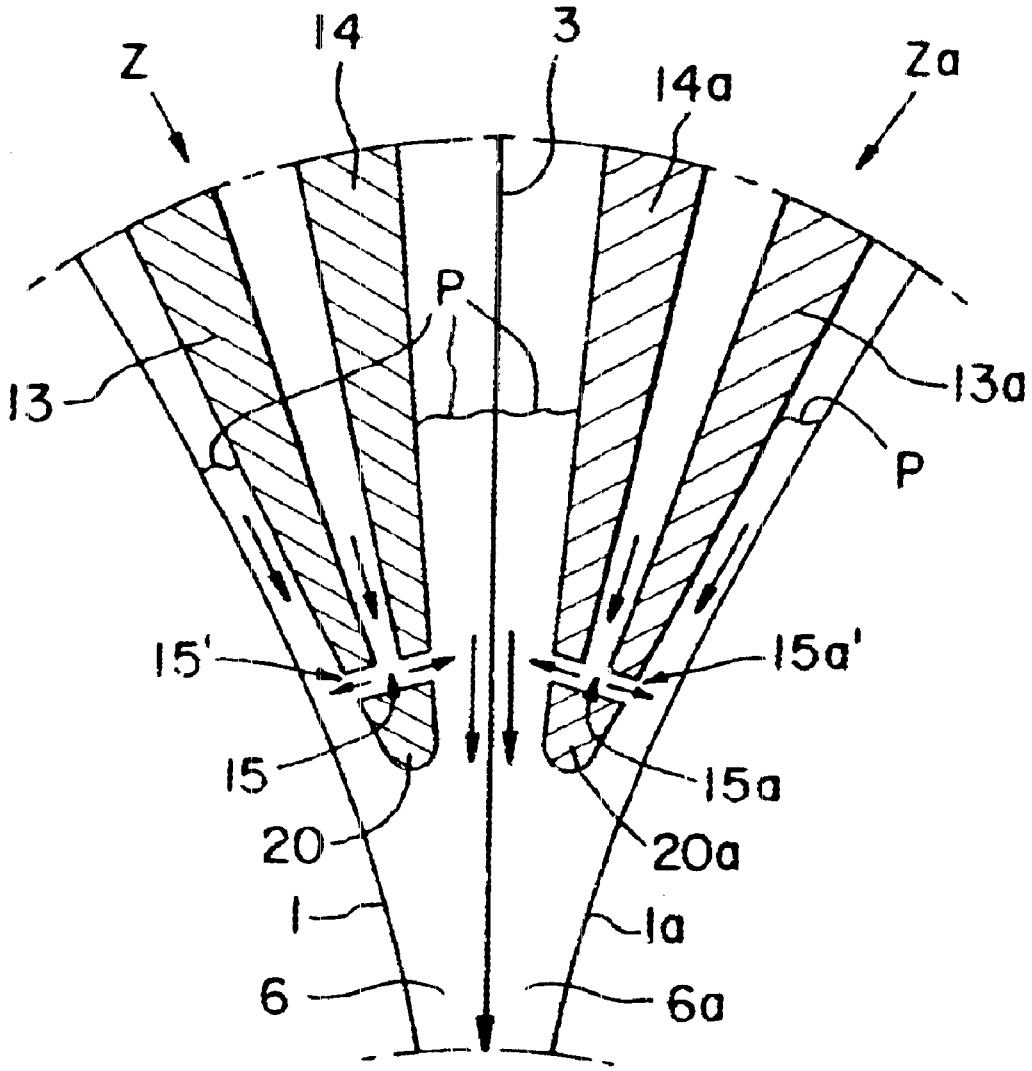
FIG. 2 is a cross-sectional view of a second embodiment of the nozzle of the present invention.

Now referring additionally to FIG. 2, there is illustrated a second embodiment of nozzle 15 and 15*a*. The remaining construction of the applicator device, in accordance with this second variation, is otherwise essentially identical to the design illustrated in FIG. 1. For this reason, the same references are used.

The coating medium is redirected by flow enhancing baffle strips 20 and 20*a*. New nozzle openings 20 and 20*a* can, therefore, be designated as cross flow openings from which the medium is always dispensed, in a radial direction, toward material web 3 that is being processed, and rolls 1 and 1*a*. The flow directions of the coating medium are indicated by small arrows in FIG. 2. Vortex formations in sumps 6 and 6*a* are further reduced by utilizing this second nozzle configuration.

Strips 20 and 20*a* are conical in shape and rounded at the end pointing toward the tip of gussets Z and Za, respectively. Strips 20 and 20*a* are either a component of respective nozzle bodies 12 and 12*a*, or part of an individual nozzle lip 13, 13*a*, 14 or 14*a*, or a separate part.

Based on how the cross section or the shape of individual nozzle lips 13, 13*a*, 14 or 14*a* are formed and on how they are mounted to respective walls 9, 10, 9*a* or 10*a*, the size of the open surface area of sump 6 and 6*a*, as well as the immersion dept of nozzle lips 13, 13*a*, 14 or 14*a* can be adjusted. This means that, depending on how deep nozzle lips 13, 13*a*, 14 or 14*a* dip into sump 6 or 6*a*, the sump level can be raised or lowered. A better penetration is reached with a higher level, due to the longer dwell time. The immersion depth may be up to 80% of the total nozzle lip length. Turbulence and splashing are greatly reduced in the device, despite the higher level. For the sake of clarity, the level, in accordance with the existing state of the art, is indicated with Pb in FIG. 1 and as P, for the adjusted level, in accordance with the current invention. Nozzle lips 13, 13*a*, 14 and 14*a* are manufactured in various sizes from synthetic material. They are simple to manufacture and to store, easy to clean, non-sensitive to corrosion and are light weight.

From FIG. 1 it can also be seen that nozzle bodies 12 and 12*a*, that is, their walls 10, 11 and 10*a*, 11*a*, respectively, are two-part, including an upper section O and a lower section U. Upper section O and lower section U are detachable, i.e. by way of screws or joints. Nozzle lips 13, 14, 13*a* and 14*a* are fastened to lower section U. This two-part design offers advantages during fabrication, as well as during assembly, dismantling or cleaning.

Moreover, kits in various lengths and widths can be provided for upper section O and lower section U, allowing the device, in accordance with the invention, to also be adapted to coaters having other roll diameters, without incurring large expenses.

Walls 10 and 11, and 10*a* and 11*a* of nozzle body 12 and 12*a*, respectively, are curved, or as illustrated in FIG. 1, kinked toward the direction of rolls 1 and 1*a*, respectively. This design makes it possible for the total device to have a low construction height, thereby offering better stability.

This adaptation also slows the flow of the medium in metering slots 9 and 9*a*, thereby providing further uniformity. This structural form also provides effective nip-inlet protection. This means that the operating personnel monitoring this process, cleaning rolls, etc. cannot be drawn into the nip by body parts or clothing.

In addition, upper section O of nozzle bodies 12 and 12*a*, and nozzle lips 13, 13*a*, 14 and 14*a*, may be fabricated from rust-free sheet metal and equipped with only a few individual stiffening ribs 16 and 16*a*, resulting in a relatively light construction of the entire device.

It is of course possible to mount delivery devices 5 and 5*a* rigidly on the housing of the roll mounting.

As illustrated in FIG. 1, pivoting devices 17 and 17*a* along with the position of nozzle bodies 12 and 12*a* and their associated nozzle openings 15 and 15*a* are adjustable. Alternatively, feed device 5 or 5*a* can be separately pivoted from rolls 1 and 1*a*, or from gussets Z and Za with sumps 6 and 6*a*. Pivoting of feed devices 5 or 5*a* when web 3 is not being processed, allows for clean-up or replacement of rolls 1 or 1*a*. Total dismantling of the device is therefore not necessary.

It should be mentioned, one more time, that the devices illustrated in FIGS. 1 and 2 are intended for two-sided, normally simultaneous application onto both sides of web 3.

Many times only single-sided application, onto only one of the two sides of web 3, is intended. On the right hand (mirror image) side of the illustration all device components are supplemented with "a". In the event of the aforementioned single-sided application the components on the left or the right side, of the illustration, can be completely eliminated or simply pivoted out of the way. It must also be mentioned that feed devices 5 and 5*a* and their respective pivoting devices 17 and 17*a* are operable independently of each other.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

| Component Identification | |
|---|---|
| Roll | 1, 1a |
| Web | 3 |
| Nip | 4 |
| Feed device | 5, 5a |
| Sump | 6, 6a |
| Main distributor pipe | 7, 7a |
| Individual distributor pipe | 8, 8a |
| Metering slot | 9, 9a |
| Wall | 10, 10a |
| Wall | 11, 11a |
| Nozzle body | 12, 12a |
| Nozzle lip | 13, 13a |
| Nozzle lip | 14, 14a |
| Nozzle opening | 15, 15a |
| Pivoting device | 17, 17a |
| Cover plate | 18, 18a |
| Baffle plate | 20, 20a |
| Upper section | O |
| Lower section | U |
| Gusset | Z, Za |

What is claimed is:

1. A device for the application of a liquid medium onto at least one side of a moving cardboard web, comprising:

at least one roll disposed proximate to and defining a liquid sump with the cardboard web, said liquid sump having a surface and containing a portion of the liquid medium; and at least one feed device disposed proximate to said at least one roll, said feed device including a nozzle body having at least two walls substantially parallel to each other defining a metering slot therebetween, and at least two nozzle lips spaced apart to form a nozzle opening therebetween at an end of said at least two nozzle lips, at least one of said at least two nozzle lips being adjustably connected with a corresponding one of said at least two walls such that said liquid medium traverses said metering slot to said nozzle opening, said nozzle opening being disposed in said liquid sump, said nozzle lips being configured to adjust a size of said surface of said liquid sump by varying at least one of shape of said nozzle lips, size of said nozzle lips and mounting of said nozzle lips to said at least two walls, said nozzle lips having a length, said nozzle lips being adjustably immersed in said liquid sump up to approximately 80% of said length.

2. The device of claim 1, wherein said at least one feed device, further comprises:

a main distributor pipe having a length; and a plurality of distributor tubes having an end connected to said main distributor pipe, said plurality of distributor tubes having an other end connected to said nozzle body, said plurality of distributor tubes uniformly located along said length of said main distributor pipe.

3. The device of claim 1, wherein said at least two nozzle lips are replaceably attached to a corresponding said at least two walls.

4. The device of claim 1, wherein said nozzle body is configured to be angularly disposed thereby matching a cross-sectional shape of one of said at least one roll.

5. The device of claim 1, wherein each said nozzle body further comprises:

an upper section including at least a portion of said at least two walls; and a lower section.

6. The device of claim 5, wherein said nozzle lips are connected to said lower section.

7. The device of claim 1, wherein said nozzle opening is configured to direct a flow of said liquid medium in a direction, said direction being approximately parallel to a direction of travel of said at least one roll and a direction of travel of said cardboard web.

8. The device of claim 1, further comprising a baffle strip disposed proximate said,nozzle opening thereby forming a new nozzle opening arranged therebetween such that said liquid medium exiting said nozzle opening flows through said new nozzle opening, said new nozzle opening configured to discharge said liquid medium into said liquid sump, in a radial cross flow manner.

9. The device of claim 1, further comprising at least one pivoting device connected to said at least one feed device.

10. The device of claim 1, wherein said at least one roll includes a first roll and a second roll, said first roll having a first axis and said second roll having a second axis, said first axis and said second axis substantially parallel, said first roll and said second roll disposed proximate each other thereby forming a nip therebetween, said cardboard web traversing through said nip, said second roll and said cardboard web forming an other liquid sump therebetween, said liquid sump and said other liquid sump being independently supplied with said liquid medium.

11. The device of claim 10, further comprising:

a first pivoting device, said at least one feed device including a first feed device and a second feed device, said first pivoting device connected to said first feed device; and a second pivoting device connected to said second feed device, said first pivoting device and said second pivoting device configured to operate independent from each other.

* * * * *

UNITED STATES PATENT AND TRADEMARK OFFICE

CERTIFICATE OF CORRECTION

PATENT NO. : 6,626,127 B2
DATED : September 30, 2003
INVENTOR(S) : Eichinger et al.

It is certified that error appears in the above-identified patent and that said Letters Patent is hereby corrected as shown below:

Column 3,
Line 20, please delete “web 4”, and substitute therefore, -- web 3 --;
Line 21, please delete “Web 4”, and substitute therefore, -- Web 3 --;
Line 67, please delete “openings 20 and 20a”, and substitute therefore, -- openings 15' and 15a' --.

Signed and Sealed this

Thirteenth Day of July, 2004

JON W. DUDAS
*Acting Director of the United States Patent and Trademark Office*